United States Patent [19]

van der Veen

[11] Patent Number: 4,643,416

[45] Date of Patent: Feb. 17, 1987

[54] AMUSEMENT RIDE VEHICLE

[76] Inventor: Guus van der Veen, Kurt-Schumacher-Str. 29, 2900 Oldenburg, Fed. Rep. of Germany

[21] Appl. No.: 859,661

[22] Filed: Oct. 11, 1984

[30] Foreign Application Priority Data

Oct. 20, 1983 [DE] Fed. Rep. of Germany ..... 3338048

[51] Int. Cl.[4] ..... A63G 1/08

[52] U.S. Cl. ..... 272/38; 272/49; 272/50; 74/86

[58] Field of Search ..... 272/28 R, 29, 38, 47, 272/48, 50, 51, 36, 49, 74, 75, 85, 86; 74/86; 5/103, 108, 109

[56] References Cited

U.S. PATENT DOCUMENTS

| | | | |
|---|---|---|---|
| 522,783 | 7/1894 | Dewey | 5/109 |
| 1,420,134 | 6/1922 | Nisle | 5/109 |
| 2,076,113 | 4/1937 | Bartlett | 272/49 X |
| 2,255,047 | 9/1941 | Ebert et al. | 74/86 X |
| 2,792,105 | 5/1957 | Wilson | 272/38 X |
| 3,612,522 | 10/1971 | Ikonen | 272/75 |
| 3,972,527 | 8/1976 | Bacon | 272/38 X |

FOREIGN PATENT DOCUMENTS

| | | | |
|---|---|---|---|
| 587023 | 10/1933 | Fed. Rep. of Germany | 272/49 |
| 2,745,145 | 6/1978 | Fed. Rep. of Germany | 272/74 |
| WO83/00204 | 1/1983 | PCT Int'l Appl. | 74/86 |
| 2447 | of 1872 | United Kingdom | 5/109 |
| 2075350 | 11/1981 | United Kingdom | 272/85 |

*Primary Examiner*—Robert A. Hafer
*Assistant Examiner*—Arnold W. Kramer
*Attorney, Agent, or Firm*—Collard, Roe & Galgano

[57] ABSTRACT

An amusement ride vehicle having a passenger gondola the ends of which are adapted to move in substantially vertical orbits diposed on planes parallel to each other. Two supports having a predetermined spacing therebetween are provided from which the passenger gondola is suspended by counter-balanced jibs adapted to move rotatably radially around the ends of the supports. Each support is provided with an independently operated driving element for the rotational radial movement of the associated jib.

6 Claims, 6 Drawing Figures

AMUSEMENT RIDE VEHICLE

The present invention relates to a device designed as an amusement ride vehicle for passengers.

It is an object of the present invention to provide a novel amusement ride vehicle for passengers at annual fairs and the like which permits the passengers to experience surprising motion effects.

According to the invention, this object is accomplished by providing a gondola-type passenger vehicle whose front and rear ends move in orbits that define planes which extend substantially vertically and which are parallel to each other.

Preferably, the gondola-type passenger vehicle of the present invention includes an elongated platform having a number of rows of seats arranged in tandem. When the front and rear ends move in orbits that are vertically disposed and which are parallel to each other, the longitudinal axis of the passenger vehicle, which, for example, if it is horizontally aligned, would also travel in an orbit such that the passenger vehicle moves in a cylindrical trajectory. The inventive innovation offers the advantage that the front and rear ends of the vehicle are capable of revolving on associated circular paths at respectively uneven speeds, causing the passenger vehicle to simultaneously perform tilting and rocking motions. It is also possible to move the front and rear ends on the associated circular paths in respective opposing directions and to additionally vary the speeds, i.e., to move each end at a different respective speed. This advantageously permits many novel types of motion effects.

It is a further object of the present invention to provide an amusement ride which can be easily transported and which can be set-up and dismantled easily. Simultaneously, it is desirable that the design of such equipment be rugged and its operation safe. In order to accomplish this object, the passenger vehicle for amusement rides according to the present invention is designed to include two supports capable of being set-up with a predetermined spacing between each other with the passenger vehicle suspended between the supports on jibs capable of rotating movement around the ends of the respective supports.

The jibs can be rotatably mounted in a trouble-free manner by means of bearings mounted on the supports wherein the passenger vehicle suspended on the jibs is thus taken along.

The driving elements required for the rotating motion may be of any desired design, and may be arranged as desired. In the amusement ride system according to the present invention it is preferable that each support have a separate driving element for the rotating motion of the associated jib. For example, the driving element may be a hydraulic motor for driving the jib. Since each jib has its own driving element, it is possible to realize the effects of motion and combinations of motions of the passenger vehicle by individually controlling the driving elements with the aid of relatively simple means.

In a simpler design of the amusement ride system, both jibs may be driven by means of a common central drive.

As described herein, the gondola-type passenger vehicle moves in cooperation with the jibs in a trajectory conforming to the circumference of a cylinder, assuming both jibs maintain identical rotating positions within the circular trajectories in which they move. With different respective rotating positions, the passenger vehicle will extend diagonally through an imaginary cylinder. For example, if one end of the passenger vehicle is held by the associated jib within a lower zone of the circular trajectory, whereas the other end of the passenger vehicle has simultaneously reached the highest point of the circular trajectory, the passenger vehicle will extend diagonally through the imaginary cylinder. Since the diagonal exceeds the length of the cylinder, which effectively is determined by the spacing between the supports, there will result a tendency to pull at least one of the circular trajectories out of the vertical plane. Consequently, the jibs will be subjected to a bending stress load. In order to avoid such stresses the amusement ride system is provided with a compensating feature which compensates for changes in spacing between the connecting points of the passenger gondola to the jibs. For example, such a compensating feature may be of a type such that each jib is articulated on its associated support so that it is capable of pivoting around an axis extending transversely to its longitudinal axis. In one embodiment, the compensating device includes a radially rotating head with a hinge supported in each support, on which head the associated jib is articulated pivotably about an axis extending transversely to the longitudinal axis of the jib. It is apparent that the compensating feature may be engineered in other ways also.

In another embodiment, the gondola-type passenger vehicle is connected with the jibs by means of a longitudinally sliding bearing, which telescopes to provide for the necessary longitudinal compensation without deflecting the jibs from the respective vertical circular trajectories in which the jibs move. Also, scissors-like lever systems of the type in parallelogram-shaped quadrilateral links may be used as compensating devices.

In a further embodiment, the compensating feature permits an additional motion effect wherein the passenger vehicle includes segments interconnected with the vehicle which are capable of being displaced with respect to one another along the longitudinal direction of the vehicle. For example, the frame of the passenger vehicle supporting the seats may include segments which are telescopically guided in and out of one another. When compensation in the length of the vehicle is necessary, the segments are displaced with respect to one another without reducing the strength of the vehicle. This displacement motion is superimposed onto the rocking and swinging motions of the passenger vehicle caused by the rotating motion of the jibs around their respective pivotal points on the supports. Also, the segments of the passenger vehicle may be coupled with each other by way of scissors-like lever systems capable of being used as compensating devices.

To achieve the required compensation, it is also possible to provide the radially rotating heads with a pivoting mounting support, so that the radially rotating heads are capable of articulated motion with respect to the stationary supports.

Naturally, the compensating devices specified above may be installed in an amusement ride system jointly or independently of each other.

Furthermore, in an advantageous implementation, the zones of the front and rear ends of the passenger vehicle are pivotably mounted on the ends of the jibs by means of universal joint bearings. With such articulation by virtue of the universal joint bearings, the passenger vehicle may be operated so that it is maintained in an upright position that is pleasant for the passengers.

According to a further development of the object of the invention, this is achieved because the effective center of gravity of the passenger vehicle is located outside of the circular trajectories in which the universal joint bearings move around the radially rotating heads of the supports. Consequently, it is located in a lower region than the universal joint bearings.

Furthermore, according to the invention, each jib extends beyond its pivotal mounting on the support, and a counterweight is disposed on this extension of the jib. Loads or stresses induced by centrifugal forces and the like can be counteracted by counterweights in a relatively simple way. In particular, such counterweights advantageously permit the use of driving elements having relatively low output ratings.

To facilitate the set-up and dismantling of the amusement ride system, each support is designed as a folding mast mounted on an undercarriage. By way of an example, the folding mast may be erected by way of hydraulic cylinders, so that when the passenger vehicle has been suspended, the amusement ride system is nearly ready to be operated as soon as the undercarriages of the respective folding masts have been driven into their operating positions.

Other objects and features of the present invention will become apparent from the following detailed description considered in connection with the accompanying drawings, which disclose several embodiments of the invention. It is to be understood that the drawings are to be used for the purposes of illustration only, and not as a definition of the limits of the invention.

In the drawings, wherein similar reference characters denote similar elements through the several views.

Figure 1:
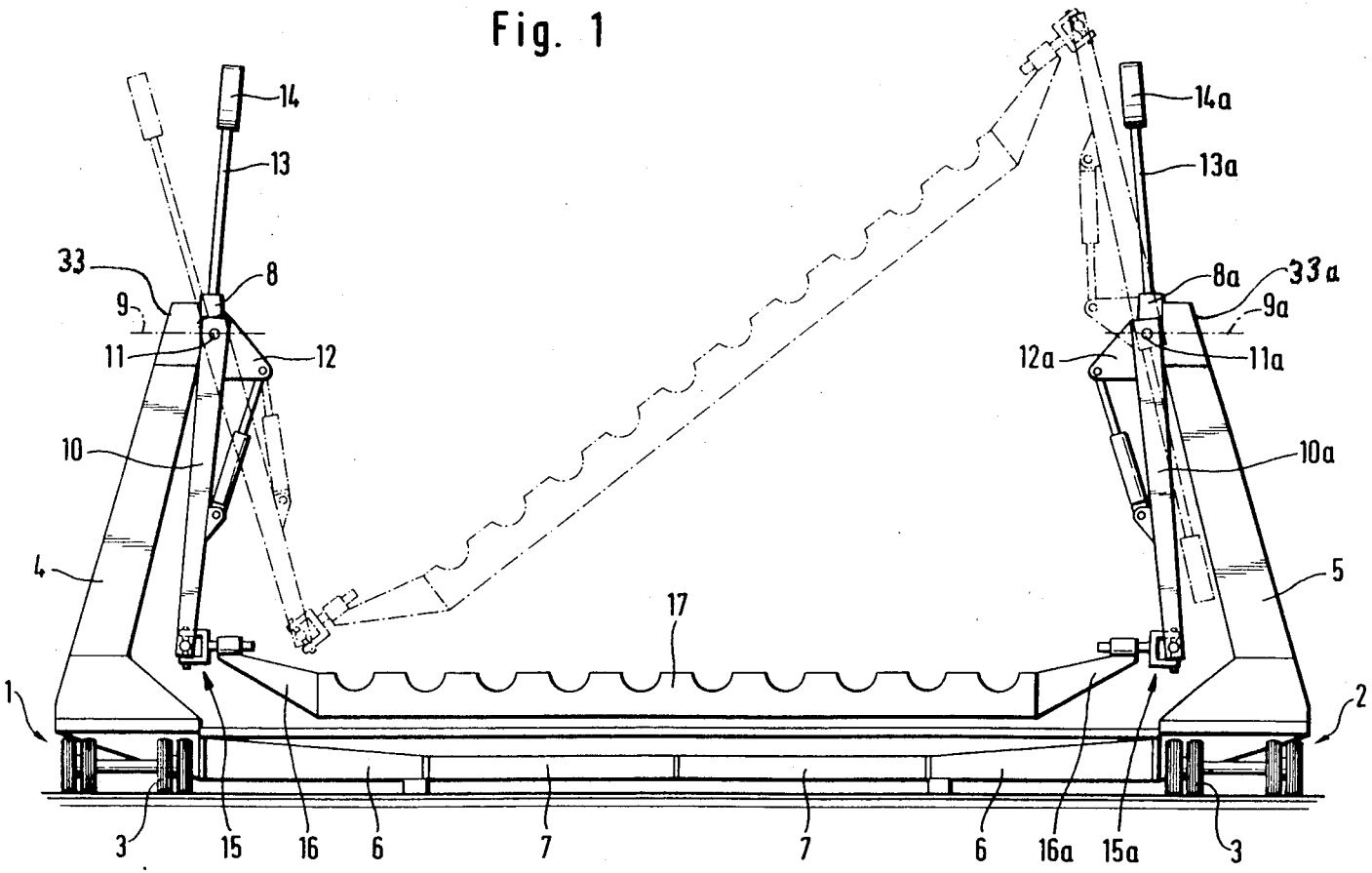
FIG. 1 is a schematic front elevational view of the amusement ride system of the present invention.

Now turning to the drawings, there is shown in FIG. 1 a schematic front view of the amusement ride system of the present invention. The undercarriages 1 and 2 with the indicated wheels 3 carry the supports 4 and 5, which are provided in the form of erectable folding masts. Undercariages 1 and 2 are set-up in parallel alignment with a predetermined spacing between each other and are supported and secured to one another with the aid of interconnected spacing plates 6 and 7. Radially rotating heads 8 and 8*a* are supported on the free ends of support 4 and 5, respectively. Each head is rotatable around horizontal axes 9 and 9*a*, respectively, by means of an associated driving element 33 and 33*a*. Each radially rotating head is provided with a joint serving as the compensating device. Each such joint supports jibs 10 and 10*a*, which are adapted to rotate around axes 11 and 11*a* of the joints. Axes 11 and 11*a* extend transversely to the longitudinal axes of the jibs. The rotating motion is indicated by the dashed position lines of the jibs. The radially rotating heads, furthermore, include side plates 12 and 12*a*, respectively, supporting a gas pressure cylinder or similar shock-absorbing element, which is used to dampen this rotating motion of the jibs around axes 11 or 11*a* of the joints.

Each jib has an extended section 13 and 13*a*, respectively, extending beyond the radially rotating heads 8 and 8*a*, with counterweights 14 and 14*a* being disposed on extensions 13 and 13*a*.

A universal joint, designated 15 or 15*a*, is disposed on the free end of each jib. The ends 16 and 16*a* of a gondola-type passenger vehicle 17 are connected with jibs 10 and 10*a*, respectively, through universal joints 15 and 15*a*.

With the rotating motion of jibs 10 and 10*a* around the axes 9 and 9*a* of radially rotating heads 8 and 8*a* of supports 4 and 5, respectively, passenger vehicle 7 can be driven in a circular trajectory and assume different respective positions of tilt while moving along the trajectory. In this way, it is possible to achieve a great number of variations in the effects of motion of the passenger vehicle.

The dashed lines show a tilted position of the passenger vehicle, which is achieved by moving jibs 10 and 10*a* independently of each other, i.e., by moving each jib separately, so that the jibs assume different respective positions within their orbits around axes 9 and 9*a*.

Figure 2:
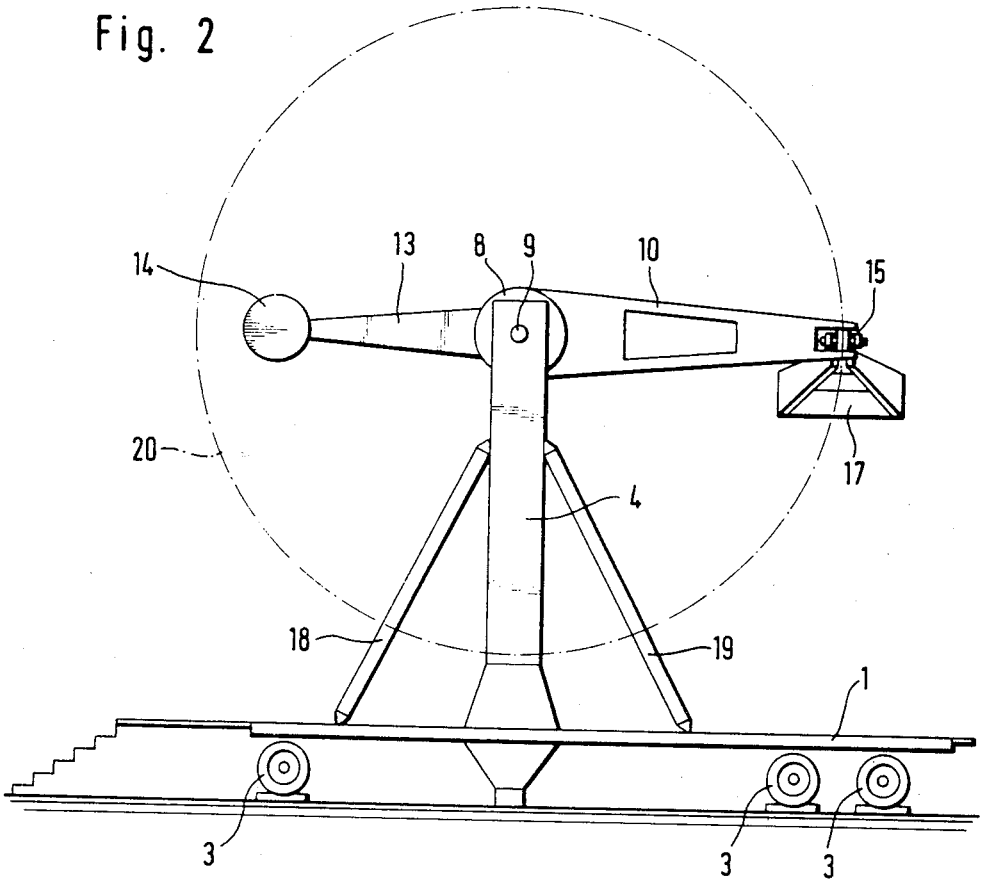
FIG. 2 is a side elevational view of the amusement ride system shown in FIG. 1.

FIG. 2 shows a lateral view of the amusement ride system according to FIG. 1. Identical components of the system are identified by identical reference numbers. The reference numerals 18 and 19 identify stiffening struts securing the support 4, which is designed as a folding mast. The dash-dotted line indicates the orbit 20 in which passenger vehicle 17 travels when jib 10 radially rotates around axis 9.

Figure 3:
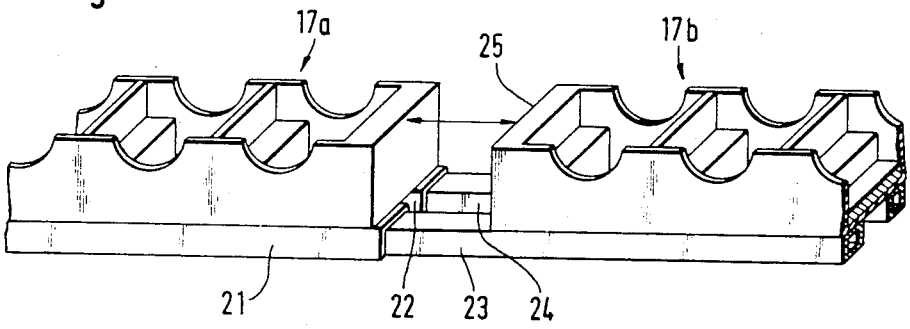
FIG. 3 is a perspective view of part of the passenger vehicle of the amusement ride system, showing an embodiment of a compensating device.

FIG. 3 shows a partial view of a gondola-type passenger vehicle which, in this case, includes two segments 17*a* and 17*b*. Segment 17*a* has supporting tubes 21 and 22 disposed within its bottom zone. Segment 17*b* has supporting struts 23 and 24 disposed within its bottom zone. Struts 23 and 24 extend beyond face 25 of segment 17*b* of the passenger vehicle and are inserted in supporting tubes 21 and 22, respectively, in a telescope-like manner. Consequently, segments 17*a* and 17*b* can be pushed back and forth in the direction of the double arrow shown between the two segments, so that the length of the passenger vehicle may vary. Such an arrangement serves as a compensating feature for compensation of changes in spacing between the ends of the jibs that occur during the operation of the amusement ride system, so that a compensating device having axes 11 and 11*a* as shown in FIG. 1 may be omitted, if need be.

Figure 4:
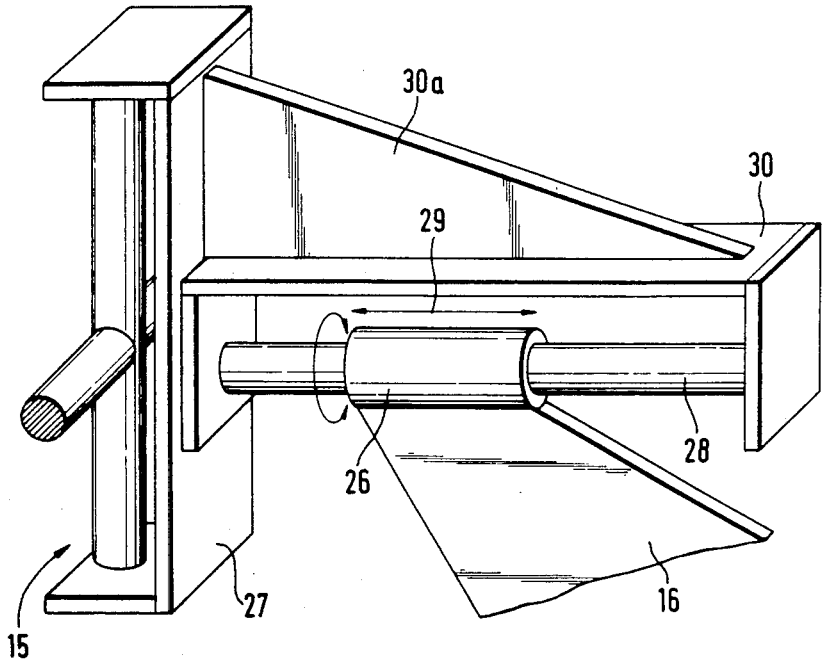
FIG. 4 is a detailed close-up view of the articulation of an end of the passenger vehicle disposed on a jib, showing a different embodiment of a compensating device.

In FIG. 4 there is shown a detail drawing of a universal joint bearing 15 fitted on the (non-illustrated) end of a jib 10 or 10*a*. Another embodiment of a compensating device was realized by securing on end 16 of the passenger vehicle a support bushing 26 capable of moving back and forth on a sliding guide 28 in the direction of double arrow 29. Guide 28 is connected with cage 27 of universal joint bearing 15. The sliding guide is supported in a U-shaped crosstie 30. Crosstie 30 is connected in a bend-resistant manner with cage 27 of universal joint bearing 15 by way of a strong or rugged reinforcing plate 30*a*. The length of sliding guide 28 is dimensioned so that any changes in the spacing between the ends of the jibs occurring during the operation of the amusement ride equipment are compensated for. Support bushing 26 and sliding guide 28 thus represent a compensating device designed in the form of a sliding bearing.

Figure 5:
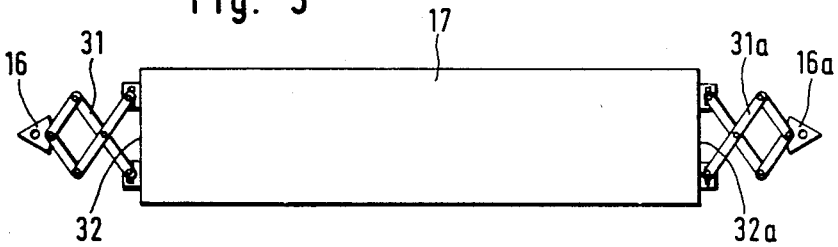
FIG. 5 is a schematic top plan view of a gondola-type passenger vehicle with a compensating device provided in the form of a scissors-like lever system.
Figure 6:
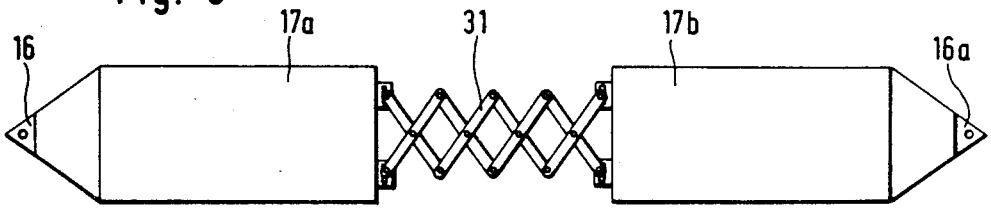
FIG. 6 is a schematic top plan view of a passenger vehicle including a compensating device in the form of another embodiment of a scissors-like lever system.

Other embodiments for designing a compensating device are shown in FIGS. 5 and 6, which illustrate schematic top plan views of a gondola-type passenger vehicle. FIG. 5 shows a compensating device in the form of a scissors-like lever system 31 and 31*a* made of parallelogram-like quadrilateral links. The scissors-like lever linkages 31 and 31*a* are arranged between ends 16 and 16*a* and the adjacent face sides 32 and 32*a*, respectively, of a gondola-type passenger vehicle.

According to FIG. 6, a scissors-type lever system 31 may be installed as a compensating device between two segments 17*a* and 17*b* of a passenger vehicle. In this case, the function of such a compensating device is comparable to the compensating device shown in FIG. 3.

It is, of course, possible also to combine several of the embodiments shown above for a compensating device on a single amusement ride vehicle.

While only a few embodiments of the present invention have been shown and described, it will be obvious that many changes and modifications may be made thereunto without departing from the spirit and scope of the invention.

What is claimed is:

1. A passenger carrying amusement ride, comprising:

(a) a pair of first and second spaced upstanding supports;

(b) first and second motor drive means mounted at the top of each said support, said motor drive means independently controllable for forward, reverse and variable speed operation;

(c) first and second upstanding jibs, each fixedly mounted approximately at its center to a respective motor drive means, one end of each jib having counter-balancing means, the other end of each respective jib supporting one end of a passenger carrying gondola means by universal coupling means; and (d) means associated with said gondola means to compensate for the variable spacing between the ends of the jibs to which said gondola means is coupled due to any asynchronization of said jibs.

2. The passenger carrying amusement ride as defined in claim 1, wherein the means to compensate for the variable spacing between the ends of the jibs comprises said gondola means consisting of two segments each supported at an opposing end to a respective jib, and means connecting said gondola means segments for axially aligned movement therebetween.

3. The passenger carrying amusement ride as defined in claim 2, wherein the means connecting said gondola means segments for axially aligned movement therebetween comprises an axially arranged tube carried by one segment and an axially arranged strut carried by the other segment, said strut being telescopically arranged with respect to said tube.

4. The passenger carrying amusement ride as defined in claim 2, wherein the means connecting said gondola means segments for axially aligned movement therebetween comprises scissors-like lever linkages connecting said segments together.

5. The passenger carrying amusement ride as defined in claim 1, wherein the means to compensate for the variable spacing between the ends of the jibs comprises scissors-like lever linkages connecting each end of said gondola means to the universal coupling means of each respective jib.

6. A passenger carrying amusement ride, comprising:

(a) a pair of first and second spaced upstanding supports;

(b) first and second motor drive means mounted at the top of each said support, said motor drive means independently controllable for forward, reverse and variable speed operation; and (c) first and second upstanding jibs, each mounted approximately at its center by mounting means to said respective motor drive means to be driven thereby, one end of each jib having counter-balancing means, the other end of each respective jib supporting one end of a passenger carrying gondola means by universal coupling means, each respective jib mounting means being rotatable about an axis substantially perpendicular to the axis of said motor drive means, whereby each jib can reciprocate about said axis to compensate for the variable spacing between the ends of the jibs to which said gondola means is coupled due to any asynchronization of said jibs.

* * * * *